US005857498A

United States Patent [19]

Barreto et al.

[11] Patent Number: 5,857,498

[45] Date of Patent: Jan. 12, 1999

[54] PAPERMAKER'S DOUBLE LAYER FORMING FABRIC

[75] Inventors: Ednaldo Vilar Barreto, Jagaribe, Brazil; Robert G. Wilson, Wake Forest, N.C.

[73] Assignee: Weavexx Corporation, Wake Forest, N.C.

[21] Appl. No.: 869,563

[22] Filed: Jun. 4, 1997

[51] Int. Cl.[6] ..... D03D 13/00

[52] U.S. Cl. ..... 139/383 A; 162/903

[58] Field of Search ..... 139/383 A; 162/903

[56] References Cited

U.S. PATENT DOCUMENTS

| | | | |
|---|---|---|---|
| 4,564,052 | 1/1986 | Borel | 139/383 A |
| 5,025,839 | 6/1991 | Wright | 139/383 A |
| 5,421,374 | 6/1995 | Wright | 139/383 A |
| 5,564,475 | 10/1996 | Wright | 139/383 A |
| 5,694,980 | 12/1997 | Quigley | 139/383 A |

*Primary Examiner*—Andy Falik
*Attorney, Agent, or Firm*—Myers, Bigel, Sibley Sajovec

[57] ABSTRACT

The forming fabric has a top machine side and an opposing bottom paper side and comprises machine direction (MD) yarns and cross machine direction (CMD) yarns interwoven in a repeating pattern of multiple repeating units. The repeating unit of the pattern comprises: paper side CMD yarns forming the paper side of the fabric; half as many machine side CMD yarns forming the machine side of the fabric; and MD yarns interwoven with both the paper side CMD yarns and the machine side CMD yarns. Within the repeating unit, each of the MD yarns passes beneath at least two paper side CMD yarns to form first and second paper side knuckles. Each of the MD yarns also passes above two machine side CMD yarns to form first and second machine side knuckles, which are separated from one another by at least two machine side CMD yarns. The machine side CMD yarn positioned beneath the first knuckle is also passed over by another MD yarn thus forming a third knuckle, separated from the first knuckle in a first direction by between one and three MD yarns. The machine side CMD yarn positioned beneath the second knuckle is also passed over by another MD yarn thus forming a fourth knuckle, separated from the second knuckle in a second direction opposite the first direction by between one and three MD yarns. In this configuration, the fabric retains the "zig-zag" configuration on the machine side of prior art fabric, but is less prone to twinning.

20 Claims, 8 Drawing Sheets

PAPERMAKER'S DOUBLE LAYER FORMING FABRIC

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a drier section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap on each end or a special foldback, then reweaving these into pin-seamable loops. In a flat woven papermakers' fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermakers' fabric on the papermaking machine, and a direction parallel to the fabric surface and transverse to the direction of travel. Both weaving methods described hereinabove are well known in the art, and the term "endless belt" as used herein refers to belts made by either method.

Effective sheet and fiber support and an absence of wire marking are important considerations in papermaking, especially for the forming section of the papermaking machine, where the wet web is initially formed. Wire marking is particularly problematic in the formation of fine paper grades, as it affects a host of paper properties, such as sheet mark, porosity, see through, and pin holing. Wire marking is the result of individual cellulosic fibers being oriented within the paper web such that their ends reside within gaps between the individual threads or yarns of the forming fabric. This problem is generally addressed by providing a permeable fabric structure with a co-planar surface which allows paper fibers to bridge adjacent yarns of the fabric rather than penetrate the gaps between yarns. As used herein, "co-planar" means that the upper extremities of the yarns defining the paper forming surface are at substantially the same elevation, such that at that level there is presented a substantially "planar" surface. Accordingly, fine paper grades intended for use in carbonizing, cigarettes, electrical condensers, quality printing, and like grades of fine paper, have typically heretofore been formed on very finely woven or fine wire mesh forming fabrics.

Such finely woven forming fabrics, however, often are delicate and lack dimensional stability in either or both of the machine and cross machine directions (particularly during operation), leading to a short service life for the fabric. In addition, a fine weave may adversely effect drainage properties of the fabric, thus rendering it less suitable as a forming fabric.

To combat these problems associated with fine weaves, multi-layer forming fabrics have been developed with fine-mesh yarns on the paper forming surface to facilitate paper formation and larger yarns on the machine contact side to provide strength and longevity. As examples, U.S. Pat. No. 4,709,732 discloses a dual layer forming fabric for use in a papermaking process, U.S. Pat. No. 5,025,839 discloses a two-ply forming fabric with zig-zagging MD yarns, and U.S. Pat. No. 4,605,595 teaches a two ply forming fabric with a two-shaft, twill or satin weave pattern.

Although double-layer fabrics have proven to be effective forming fabrics for many applications, they can be expensive to manufacture. Also, different paper varieties are generally produced on different types of fabrics. For example, a high grade paper, such as that used in magazines and printers, is typically produced on a considerably different fabric than a tissue paper, which has significantly more lenient surface standards. Accordingly, fabric designers are constantly searching for new designs that provide an appropriate balance of performance characteristics and cost.

One example of a double-layer fabric which is suitable for forming tissue paper is disclosed in U.S. Pat. No. 5,025,839 to Wright. This fabric employs MD yarns that are interwoven with the machine side CMD yarns in an "under 1/over 1/under 1/over 5" pattern, the result of which is the MD yarns producing a "zigzag" effect that reportedly improves drainage. The MD yarns are interwoven with the CMD yarns of the paper side of the fabric in an "over 1/under 2/over 1/under 12" repeating pattern, with the MD yarns interlacing with the machine side CMD yarns in the "under 12" sections.

Unfortunately, this fabric has proven to be prone to "twinning" of its paper side CMD yarns in the "under 2" positions of the pattern (the positions between the locations where the MD yarns pass over the paper side CMD yarns to form paper side "knuckles"). Twinning is an effect in which adjacent paper side CMD yarns tend to reside near one another rather than being spaced apart a uniform distance. This is caused by tension in the machine direction yarns due to the "under 1/over 1/under 1" portion of the machine side pattern, which is a tension-inducing configuration. This tension forces the "under 2" paper side CMD yarns together in a "twinned" configuration. Twinning can result in uneven drainage through the paper side layer due to the disparity in drainage hole size.

SUMMARY OF THE INVENTION

In view of the foregoing, it is an object of the present invention to provide a forming fabric having a sound balance of strength, drainage, and surface characteristics.

It is also an object of the present invention to provide a forming fabric that reduces twinning of paper side CMD yarns.

It is another object of the present invention to provide a forming fabric suitable for the formation of tissue paper.

These and other objections are satisfied by the present invention, which relates to a papermakers' forming fabric that is particularly suitable for forming tissue paper. The forming fabric has a top machine side and an opposing bottom paper side and comprises machine direction yarns and cross machine direction yarns interwoven in a repeating pattern of multiple repeating units. The repeating unit of the pattern comprises: a first preselected number of paper side cross-machine direction yarns forming the paper side of the fabric; a second preselected number of machine side cross-machine direction yarns forming the machine side of the fabric; and a third preselected number of machine direction yarns interwoven with both the paper side cross machine direction yarns and the machine side cross machine direction yarns. The first preselected number of paper side cross machine direction yarns is twice as large as the second preselected number of machine side cross machine direction yarns. Within the repeating unit, each of the machine direction yarns passes above two machine side cross machine direction yarns to form first and second machine side knuckles; these machine side knuckles are separated from one another by at least two machine side cross machine direction yarns. Each of the machine direction yarns also passes beneath at least two paper side cross machine direction yarns to form first and second paper side knuckles. The machine side cross machine direction yarn positioned beneath the first knuckle is also passed over by another machine direction yarn that forms a third machine side knuckle thereon. The third machine side knuckle is separated from the first machine side knuckle in a first direction by between one and three machine side cross machine direction yarns. The machine side cross machine direction yarn positioned beneath the second machine side knuckle is also passed over by another machine direction yarn that forms a fourth machine side knuckle thereon. The fourth machine side knuckle is separated from the second machine side knuckle in a second direction opposite the first direction by between one and three machine side cross machine direction yarns. In this configuration, the fabric retains the "zig-zag" configuration on the machine side of prior art fabric, but is less prone to twinning.

In a preferred embodiment, the repeating unit of the fabric includes 16 machine side CMD yarns, 32 paper side CMD yarns, and 16 machine direction yarns. The machine direction yarns are interwoven such that the first and second paper side knuckles are separated by two paper side CMD yarns. Also, the first and third machine side knuckles are separated by two MD yarns, as are the second and fourth machine side knuckles. This configuration provides a machine side configuration with superior wear resistance and a paper side configuration that is particularly suitable for tissue paper forming.

DETAILED DESCRIPTION OF THE INVENTION

The present invention will now be described more particularly hereinafter with reference to the accompanying drawings, in which present embodiments of the present invention are shown. The invention may, however, be embodied in many different forms and is not limited to the embodiment set forth herein; rather, this embodiment is provided so that the disclosure will fully convey the scope of the invention to those skilled in this art.

Figure 1:
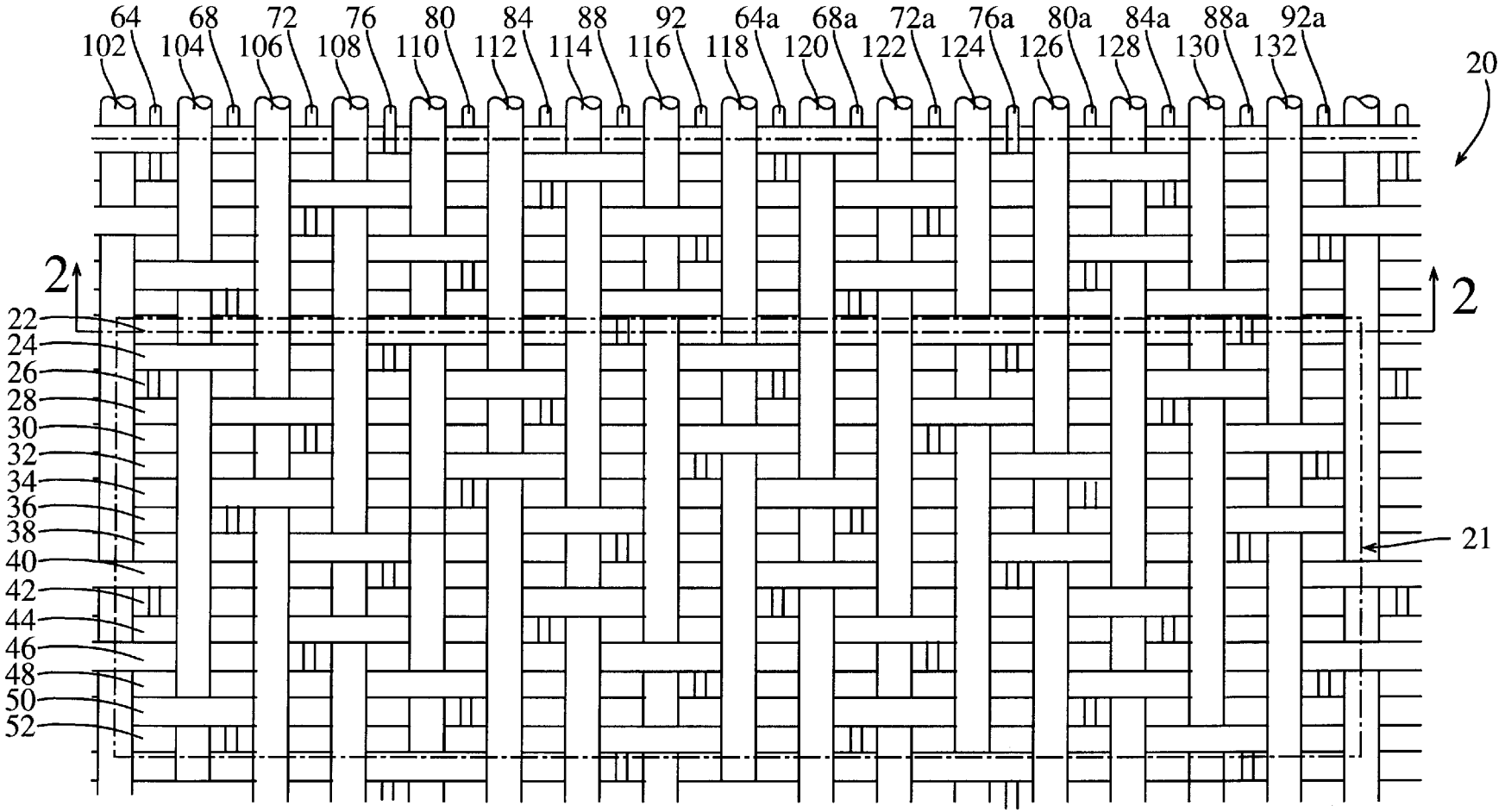
FIG. 1 is a schematic plan view of the machine side of the forming fabric of the present invention; this view does not illustrate the "zig-zag" effect of the MD yarns on the machine side of the fabric in order to clarify the interweaving pattern of the fabric.

Referring now to the drawings, a double layer fabric 20 is illustrated in FIG. 1. The double layer fabric 20 includes a number of repeating units (one of which is designated at 21 in FIG. 1) formed of machine direction (MD) yarns which interlace with paper side cross-machine direction (CMD) yarns and machine side CMD yarns. The sixteen MD yarns of the illustrated repeating unit are designated at 22, 24, 26, 28, 30, 32, 34, 36, 38, 40, 42, 44, 46, 48, 50, and 52.

These MD yarns are interwoven with two different sets of CMD yarns: those forming the paper side layer 60 of the fabric 20; and those forming the machine side layer 100. For each repeating unit, a total of thirty-two paper side CMD yarns are included. These are designated in FIGS. 1–17 at 62, 64, 66, 68, 70, 72, 74, 76, 78, 80, 82, 84, 86, 88, 90, 92, 62*a*, 64*a*, 66*a*, 68*a*, 70*a*, 72*a*, 74*a*, 76*a*, 78*a*, 80*a*, 82*a*, 84*a*, 86*a*, 88*a*, 90*a*, and 92*a*. The machine side CMD layer 100 comprises sixteen machine side CMD yarns; these are designated at 102, 104, 106, 108, 110, 112, 114, 116, 118, 120, 122, 124, 126, 128, 130 and 132.

Figure 2:
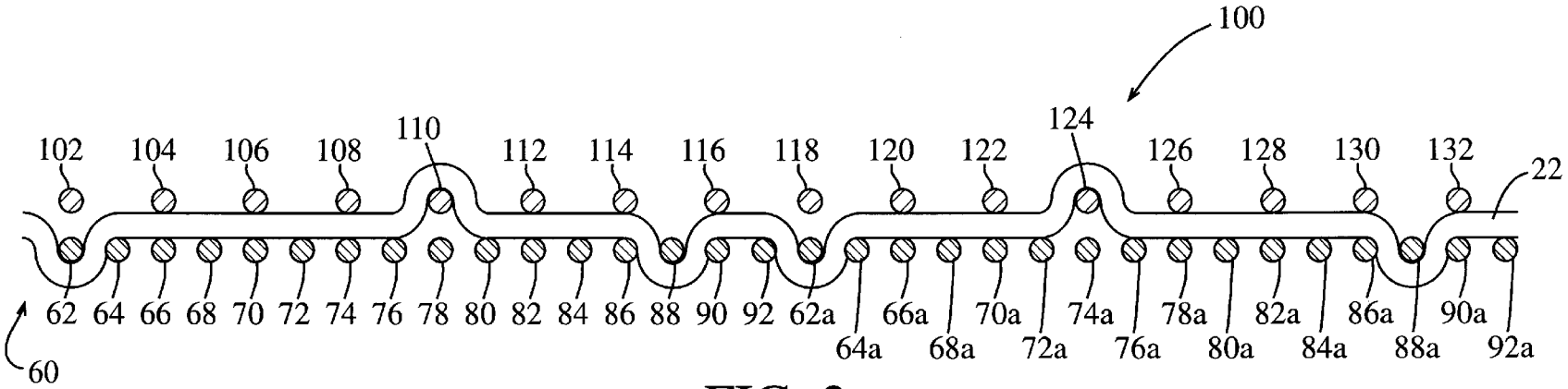
FIGS. 2 through 17 are section views taken along successive machine direction yarns illustrating the interlacing pattern of the machine direction yarns relative to the upper and lower cross-machine direction yarns.
Figure 3:
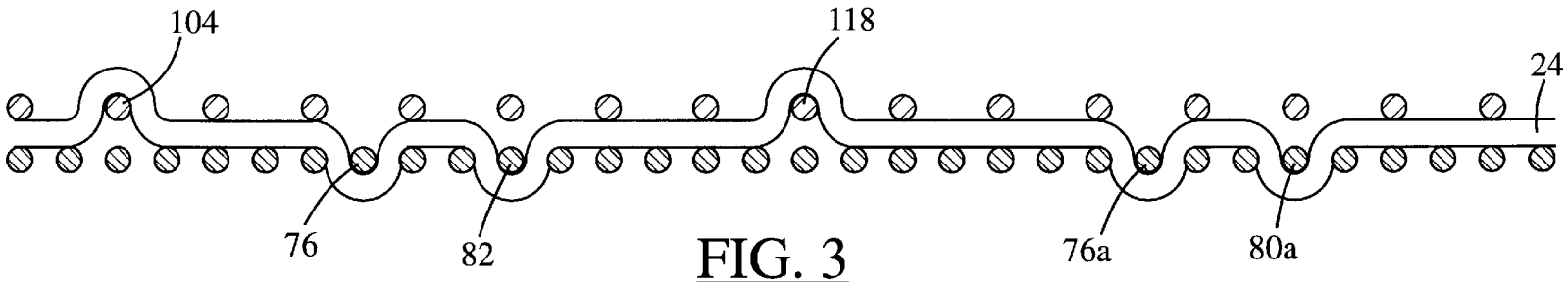
Figure 4:
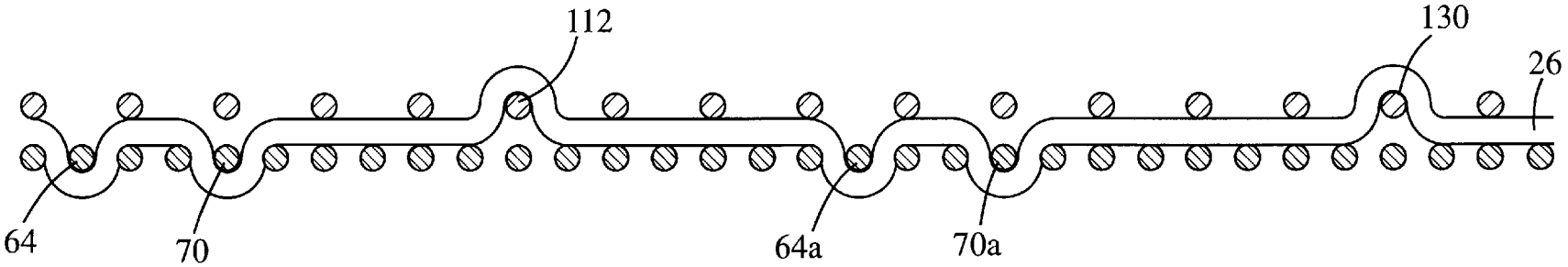
Figure 5:
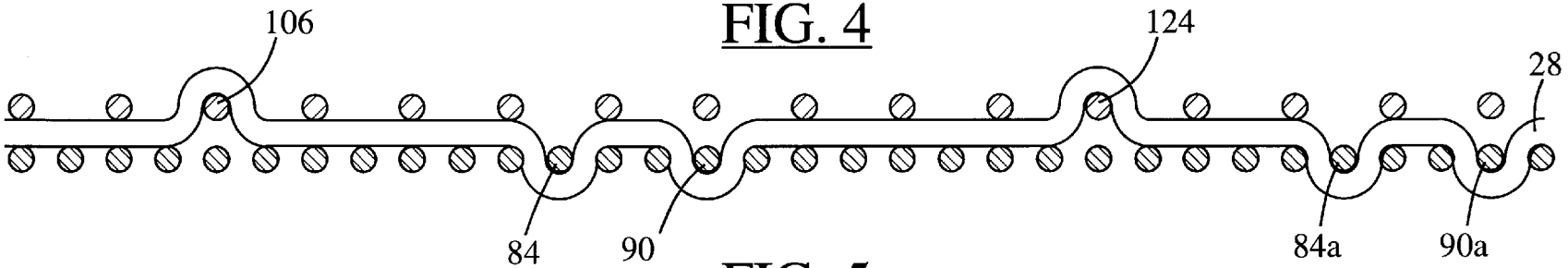
Figure 6:
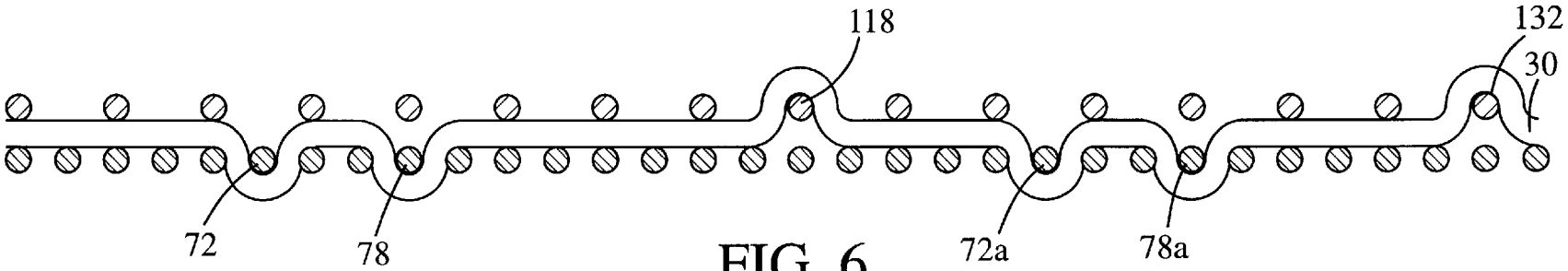
Figure 7:
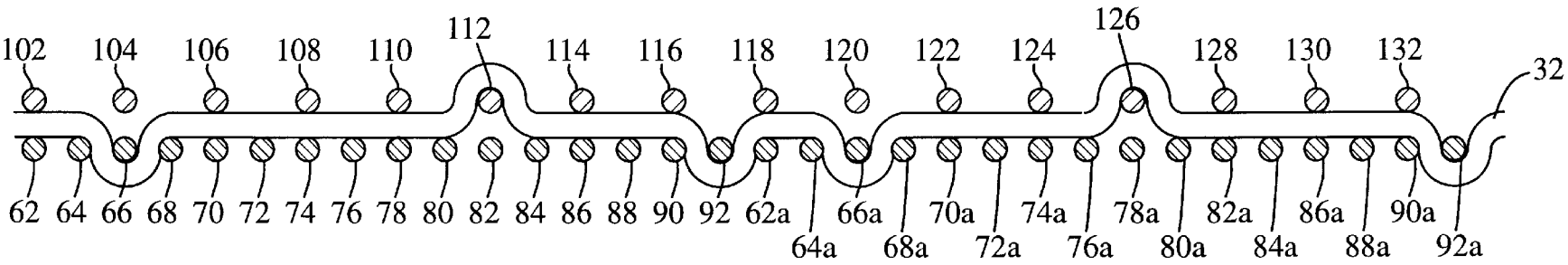
Figure 8:
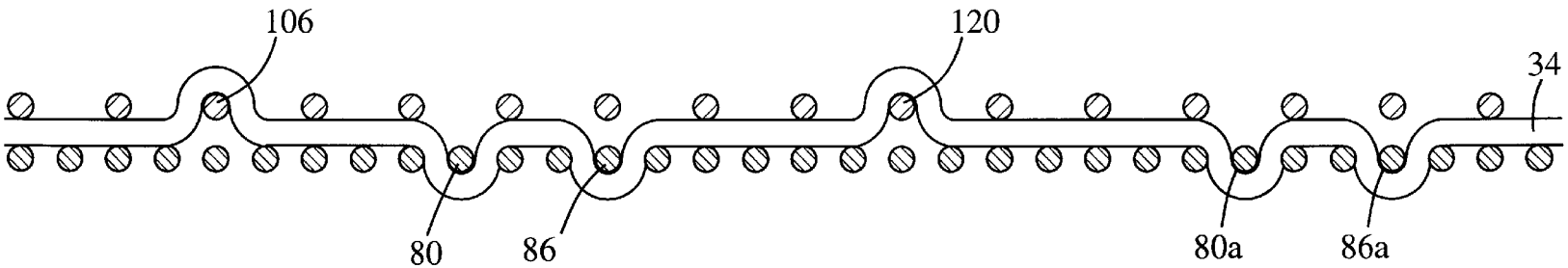
Figure 9:
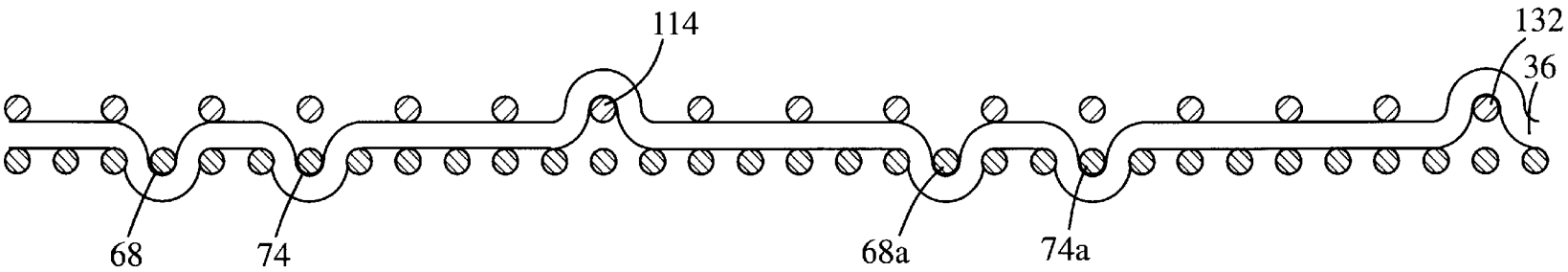
Figure 10:
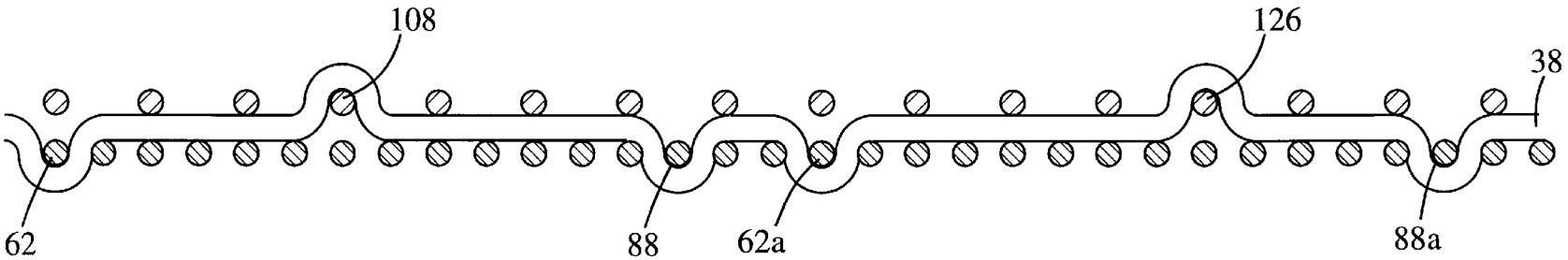
Figure 11:
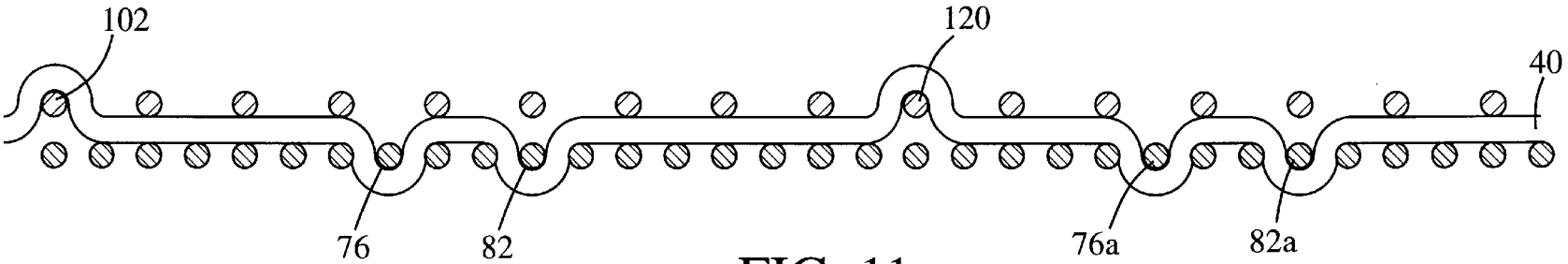
Figure 12:
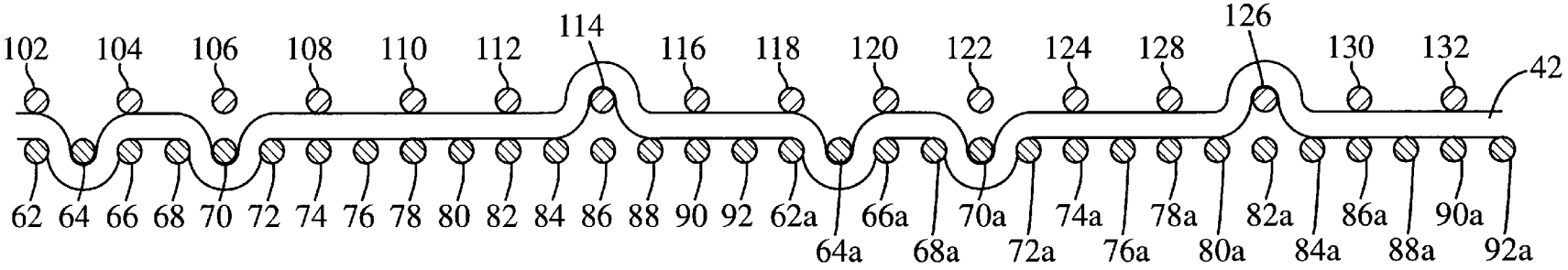
Figure 13:
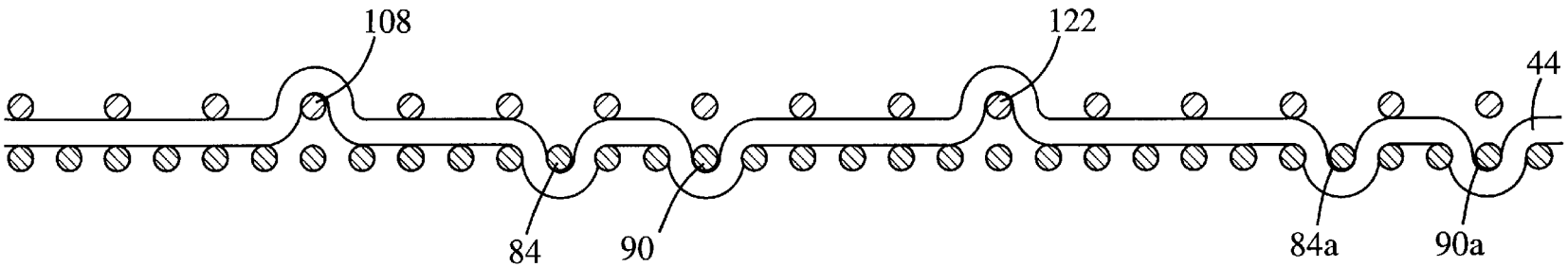
Figure 14:
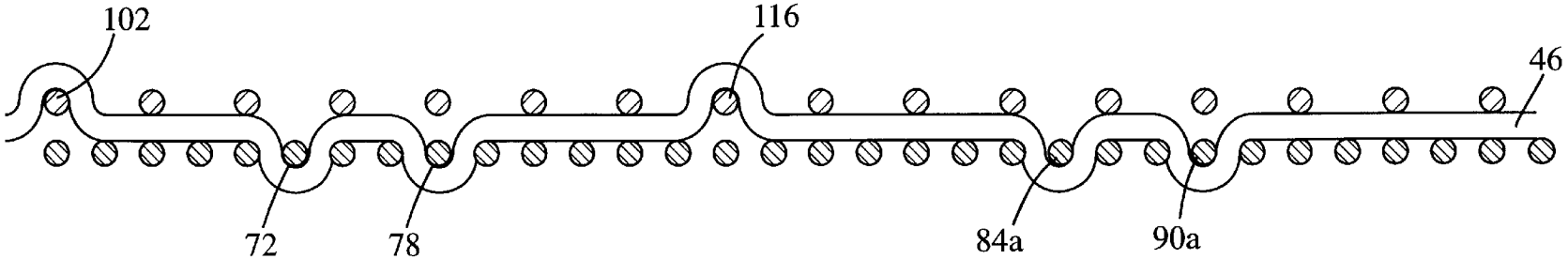
Figure 15:
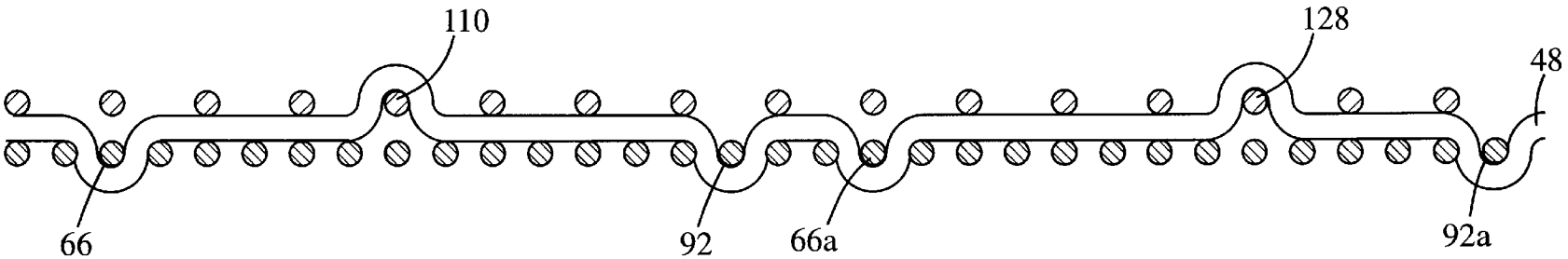
Figure 16:
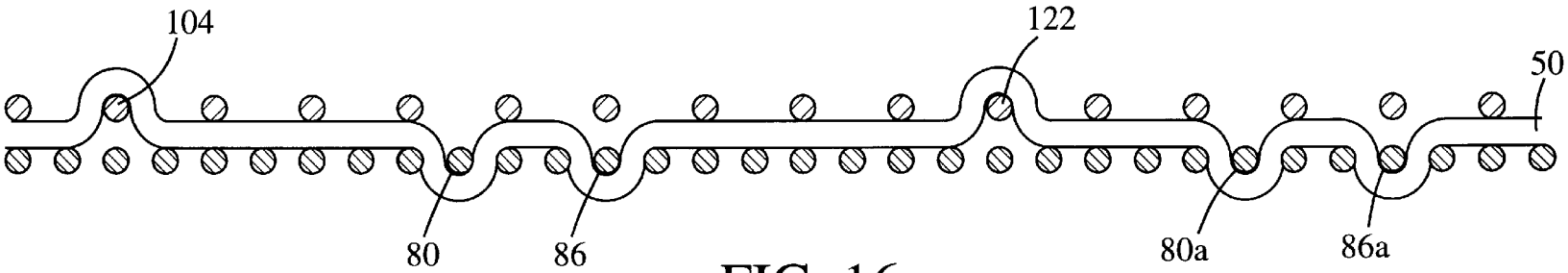
Figure 17:
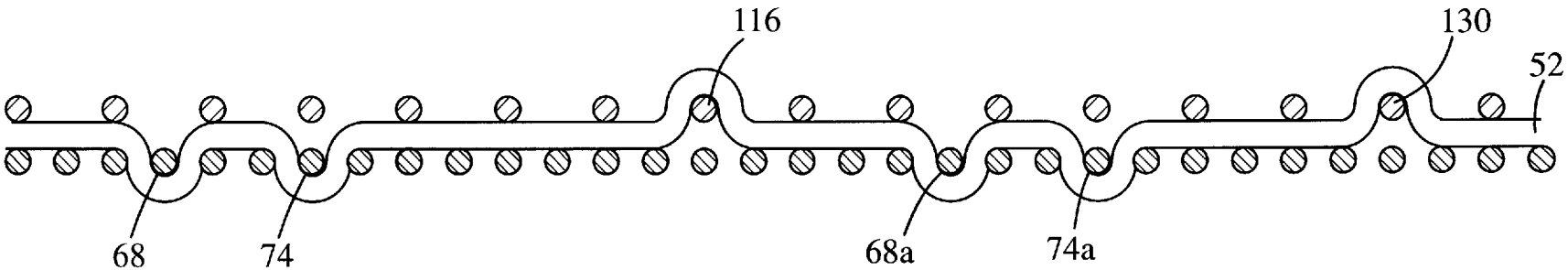

The interweaving pattern of the individual MD yarns is best understood by reference to FIGS. 2 through 17, each of which illustrates the interweaving of one MD yarn through the paper side and machine side CMD yarns. For example, FIG. 2 shows the MD yarn 22 as it passes under paper side CMD yarn 62, over the paper side CMD yarns 64 through 86, below paper side CMD yarn 88, and above paper side CMD yarns 90 and 92. For the purposes of explanation herein, "above," "up," and the like refer to the direction the machine side of the fabric 20 faces (toward the top of the page in FIGS. 2–17), and "below," "beneath," and the like refer to the direction of the paper side of the fabric faces. This interweaving pattern for the MD yarn 22 is repeated for paper side CMD yarns 62*a* through 92*a*. Thus, the MD yarn 22 has a "under 1/over 1/under 1/over 2" repeat pattern as it interlaces with the paper side CMD yarns. For the repeat unit illustrated in FIG. 1, the over 1/under 2/over 1/under 12 pattern is repeated twice.

Still referring to FIG. 2, as the MD yarn 22 passes between paper side CMD yarns 62 through 92*a*, it also interweaves with the machine side CMD yarns. More specifically, the MD yarn 22 passes below machine side CMD yarns 102, 104, 106 and 108, passes above machine side CMD yarn 110, passes below machine side CMD yarns 112 through 122, passes above machine side CMD yarn 124, then passes below machine side CMD yarns 126 through 132. Thus, the MD yarn 22 has an "under 6/over 1/under 8/over 1" interweaving pattern relative to the machine side CMD yarns.

As can be seen in FIGS. 3 through 17, each of the remaining MD yarns 24 through 52 follow the same weave pattern relative to the paper and machine side CMD yarns. Each MD yarn follows an under 1/over 12/under 1/over 12 pattern relative to the paper side CMD yarns, and an over 1/under 6/over 1/under 8 pattern relative to the machine side CMD yarns.

Adjacent MD yarns are interlaced relative to the paper side CMD yarns on a 6 paper side CMD yarn offset; i.e., the knuckles formed by the MD yarns on the paper surface by one MD yarn are separated from the corresponding knuckles on adjacent MD yarns by 6 paper side CMD yarns. For example, the MD yarn 22 forms a first paper side knuckle as it passes under the paper side CMD yarn 88 and another paper side knuckle as it passes under the paper side CMD yarn 62*a*. The next adjacent MD yarn 24 forms paper side knuckles as it passes under the paper side CMD yarn 76 and the paper side CMD yarn 82, each of which are separated from their corresponding knuckles from the MD yarn 22 by 6 CMD paper side yarns. This 6 paper side CMD yarn offset is carried through the repeat unit of the fabric 20.

In addition, and as can be seen in FIG. 1, the machine side knuckles of each MD yarn are separated from their corresponding knuckles on adjacent MD yarns by a 3 machine side CMD yarn offset. As an example, the MD yarn 22 forms a machine side knuckle as it passes above the machine side CMD yarn 110 and another machine side knuckle as it passes above the machine side CMD yarn 124. The next adjacent MD yarn, which is MD yarn 24, forms a machine side knuckle as it passes above the machine side CMD yarn 104 and another machine side knuckle as it passes above the machine side CMD yarn 118. Thus, these machine side knuckles of adjacent MD yarns are offset from one another by 3 machine side CMD yarns.

Referring again to FIG. 1, it can be seen that this weave pattern causes machine side knuckles to be formed on the same machine side CMD yarn by MD yarns that are separated by two MD yarns. For example, the machine direction yarn 22 forms a machine side knuckle as it passes above the machine side CMD yarn 124. Moving over two MD yarns to the MD yarn 28, it can be seen that the MD yarn 28 also forms a machine side knuckle as it passes above the machine side CMD yarn 124. This is a desirable configuration for the machine side of a fabric, as separation of machine side knuckles formed on the same machine side CMD yarn by one, two or three adjacent MD yarns has been shown to provide suitable wear characteristics. The effect of having two adjacent machine direction yarns located between machine direction yarns which form knuckles on the same machine side CMD yarn is that the "zig-zag" effect produced by other double-layer fabrics, such as the fabric disclosed in U.S. Pat. No. 5,025,839 to Wright, is desirably preserved (this effect, which is illustrated in exaggerated detail in the drawings of U.S. Pat. No. 5,025,839, the disclosure of which is incorporated by reference herein in its entirety, is not illustrated in FIG. 1 for the purpose of clarity of the weave pattern).

In addition, the inclusion of two or more adjacent machine side CMD yarns between machine side knuckles can diminish considerably the twinning effect that has been present in prior art double-layer fabrics having zig-zagging machine side CMD yarns. The separation of these machine side knuckles tends to reduce the tension in the MD yarns in the sections thereof between the paper side knuckles. Accordingly, the paper side CMD yarns receive less twinning force from the MD yarns. As a result, drainage through the fabric 20 can be improved.

The form of the yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of cotton, wool, polypropylene, polyester, aramid, nylon, or the like. The skilled artisan should select a yarn material according to the particular application of the final fabric.

Preferably, the paper side CMD yarns are of a smaller diameter than the machine side CMD yarns, with the diameter of the MD yarns being between about 0.10–0.20 mm, and preferably between about 0.12 and 0.15 mm. The particular size of the MD and CMD yarns is typically governed by the size and spacing of the papermaking surface CMD yarns of the base fabric. Generally, the diameter of the paper side CMD yarns is about 50 to 75 percent of the diameter of the machine side CMD yarns, and the diameter of the MD yarns is about equal to the diameter of the paper side CMD yarns.

The foregoing embodiments are illustrative of the present invention, and are not to be construed as limiting thereof. The invention is defined by the following claims, with equivalents of the claims to be included therein.

That which is claimed is:

1. A papermakers' forming fabric, said fabric having a top machine side and an opposing bottom paper side and comprising machine direction yarns and cross machine direction yarns interwoven in a repeating pattern of multiple repeating units, wherein a repeating unit of said pattern comprises:

a first preselected number of paper side cross-machine direction yarns forming said paper side of said fabric;

a second preselected number of machine side cross-machine direction yarns forming said machine side of said fabric, said first preselected number being twice as large as said second preselected number;

a third preselected number of machine direction yarns, each of said machine direction yarns being interwoven with both said paper side cross machine direction yarns and said machine side cross machine direction yarns;

wherein, within said repeating unit, each of said machine direction yarns passes above two machine side cross machine direction yarns to form first and second machine side knuckles, said first and second machine side knuckles being separated from one another by at least two machine side cross machine direction yarns, and each of said machine direction yarns passes beneath at least two paper side cross machine direction yarns to form first and second paper side knuckles;

and wherein the machine side cross machine direction yarn beneath said first knuckle is also passed over by another machine direction yarn that forms a third machine side knuckle thereon, said third machine side knuckle being separated from said first machine side knuckle in a first direction by between one and three machine direction yarns;

and wherein the machine side cross machine direction yarn beneath said second machine side knuckle is also passed over by another machine direction yarn that forms a fourth machine side knuckle thereon, said fourth machine side knuckle being separated from said second machine side knuckle in a second direction opposite said first direction by between one and three machine direction yarns.

2. The papermakers' forming fabric defined in claim 1, wherein each of said machine side cross machine direction yarns has a first diameter, each of said paper side cross machine direction yarns has a second diameter, and the ratio between said first and second diameters is between about 50 and 75 percent.

3. The papermakers' forming fabric defined in claim 2, wherein each of said machine direction yarns has a third diameter, and the ratio between said second and third diameters is between about 50 and 75 percent.

4. The papermakers' forming fabric defined in claim 1, wherein said first preselected number of paper side cross-machine direction yarns is 32, and said second preselected number of machine side cross machine direction yarns is 16.

5. The papermakers' forming fabric defined in claim 4, wherein said third preselected number of machine direction yarns is 16.

6. The papermakers' forming fabric defined in claim 1, wherein each of said machine side cross machine direction yarns is substantially aligned with a respective paper side cross machine direction yarn.

7. The papermakers' forming fabric defined in claim 6, wherein alternate paper side cross machine direction yarns are substantially aligned with respective machine side cross machine direction yarns.

8. The papermakers' forming fabric defined in claim 1, wherein said first and third machine side knuckles are separated by two adjacent machine side cross machine direction yarns, and said second and fourth machine side knuckles are separated by two adjacent machine direction yarns.

9. The papermakers' forming fabric defined in claim 8, wherein said first and second machine side knuckles are separated by either six or eight machine direction yarns, and said third and fourth machine side knuckles are separated by either six or eight machine direction yarns.

10. The papermakers' forming fabric defined in claim 1, wherein said first and second paper side knuckles are separated by either two or twelve machine direction yarns.

11. A method of making paper, comprising the steps of:

(a) providing a papermakers' forming fabric, said fabric having a top machine side and an opposing bottom paper side and comprising machine direction yarns and cross machine direction yarns interwoven in a repeating pattern of multiple repeating units, wherein a repeating unit of said pattern comprises:

a first preselected number of paper side cross-machine direction yarns forming said paper side of said fabric;

a second preselected number of machine side cross-machine direction yarns forming said machine side of said fabric, said first preselected number being twice as large as said second preselected number;

a third preselected number of machine direction yarns, each of said machine direction yarns being interwoven with both said paper side cross machine direction yarns and said machine side cross machine direction yarns;

wherein, within said repeating unit, each of said machine direction yarns passes above two machine side cross machine direction yarns to form first and second machine side knuckles, said first and second machine side knuckles being separated from one another by at least two machine side cross machine direction yarns, and each of said machine direction yarns passes beneath at least two paper side cross machine direction yarns to form first and second paper side knuckles;

and wherein the machine side cross machine direction yarn beneath said first knuckle is also passed over by another machine direction yarn that forms a third machine side knuckle thereon, said third machine side knuckle being separated from said first machine side knuckle in a first direction by between one and three machine direction yarns;

and wherein the machine side cross machine direction yarn beneath said second machine side knuckle is also passed over by another machine direction yarn that forms a fourth machine side knuckle thereon, said fourth machine side knuckle being separated from said second machine side knuckle in a second direction opposite said first direction by between one and three machine direction yarns;

(b) applying paper stock to said forming fabric; and (c) removing water from said paper stock.

12. The method defined in claim 11, wherein each of said machine side cross machine direction yarns has a first diameter, each of said paper side cross machine direction yarns has a second diameter, and the ratio between said first and second diameters is between about 50 and 75 percent.

13. The method defined in claim 12, wherein each of said machine direction yarns has a third diameter, and the ratio between said second and third diameters is between about 50 and 75 percent.

14. The method defined in claim 11, wherein said first preselected number of paper side crossmachine direction yarns is 32, and said second preselected number of machine side cross machine direction yarns is 16.

15. The method defined in claim 14, wherein said third preselected number of machine direction yarns is 16.

16. The method defined in claim 11, wherein each of said machine side cross machine direction yarns is substantially aligned with a respective paper side cross machine direction yarn.

17. The method defined in claim 16, wherein alternate paper side cross machine direction yarns are substantially aligned with respective machine side cross machine direction yarns.

18. The method defined in claim 11, wherein said first and third machine side knuckles are separated by two adjacent machine direction yarns, and said second and fourth machine side knuckles are separated by two adjacent machine direction yarns.

19. The method defined in claim 18, wherein said first and second machine side knuckles are separated by either six or eight machine direction yarns, and said third and fourth machine side knuckles are separated by either six or eight machine direction yarns.

20. The method defined in claim 11, wherein said first and second paper side knuckles are separated by either two or twelve machine direction yarns.

* * * * *